US006904245B2

(12) United States Patent
Mochizuki et al.

(10) Patent No.: US 6,904,245 B2
(45) Date of Patent: Jun. 7, 2005

(54) IMAGE FORMING APPARATUS WITH TRANSFER BIAS CONTROLLED BY A DETECTED TEST PATTERN

(75) Inventors: Jun Mochizuki, Ibaraki (JP); Takeshi Tomizawa, Chiba (JP); Makoto Saito, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/665,427

(22) Filed: Sep. 22, 2003

(65) Prior Publication Data

US 2004/0062560 A1 Apr. 1, 2004

(30) Foreign Application Priority Data

Sep. 30, 2002 (JP) ..... 2002-287218
Aug. 18, 2003 (JP) ..... 2003-294632

(51) Int. Cl.[7] ..... G03G 15/00
(52) U.S. Cl. ..... 399/49
(58) Field of Search ..... 399/49, 46, 48, 399/66, 50, 51, 127

(56) References Cited

U.S. PATENT DOCUMENTS 5,887,218 A * 3/1999 Yuu et al. ..... 399/44
5,926,669 A 7/1999 Sugimoto et al. ..... 399/66
6,167,212 A 12/2000 Satoh et al. ..... 399/55
6,226,469 B1 5/2001 Suzuki et al. ..... 399/66
6,272,306 B1 8/2001 Saito et al. ..... 399/270
6,385,409 B2 5/2002 Suzuki et al. ..... 399/66
6,434,348 B1 8/2002 Tomizawa ..... 399/66
2001/0009614 A1 7/2001 Suzuki et al. ..... 399/44

FOREIGN PATENT DOCUMENTS

JP 10048968 A * 2/1998 ..... G03G/15/16

* cited by examiner

*Primary Examiner*—Quana Grainger
(74) *Attorney, Agent, or Firm*—Fitzpatrick, Cella, Harper & Scinto

(57) ABSTRACT

An image forming apparatus includes a charging portion for charging an image bearing member, an exposure portion for exposing the image bearing member that has been charged to form an electrostatic latent image, a developing portion for developing the electrostatic latent image with developer, a transferring portion to which a transferring bias under constant voltage control is applied to transfer a developer image on the image bearing member onto other member, a test pattern forming portion for forming a test pattern for image control on the image bearing member by supplying developer by the developing portion to an area on the image bearing member in which charging by the charging portion is effected and exposure by said exposure portion is not effected, and a test pattern detection portion for detecting the test pattern that has been transferred to the other member by the transferring portion, wherein the value of the transferring bias upon transferring of the test pattern onto the other member is set in accordance with the surface potential of the image bearing member upon formation of the test pattern.

11 Claims, 13 Drawing Sheets

IMAGE FORMING APPARATUS WITH TRANSFER BIAS CONTROLLED BY A DETECTED TEST PATTERN

BACKGROUND OF THE INVENTION

1. Field of the Invention

The present invention relates to an image forming apparatus such as a printer, a copying machine or the like. More particularly, the present invention relates to an image forming apparatus that forms a predetermined test pattern and transfers it to a transferring material during a time other than ordinary image forming process and then detects the test pattern so as to perform an image control such as a density control.

2. Related Background Art

Conventionally, in image forming apparatus using an electrophotography process, a control process called ATVC (Active Transfer Voltage Control) is performed in connection with transfer means using a contact electrification process. The ATVC is to cause a current to flow in a transferring portion during a non-image-forming period to determine an optimal transferring bias based on the values of the current and the voltage at that time.

An image forming process in a full color image forming apparatus utilizing a four color process and a multi intermediate transfer process will be described with reference to FIG. 9.

The apparatus shown in FIG. 9 has image forming means in the form of four image forming stations A, B, C and D for forming toner images of yellow (Y), magenta (M), cyan (C) and black (K) respectively. Each image forming station A, B, C or D is provided with processing units such as a photosensitive drum 1*a*, 1*b*, 1*c* or 1*d*, a charging roller 2*a*, 2*b*, 2*c* or 2*d*, an exposure apparatus 3*a*, 3*b*, 3*c*, or 3*d*, a developing apparatus 4*a*, 4*b*, 4*c* or 4*d*, a primary transfer roller 53*a*, 53*b*, 53*c* or 53*d* and a cleaning apparatus 6*a*, 6*b*, 6*c* or 6*d*. The above-mentioned primary transfer rollers 53*a* to 53*d* are connected with power sources for applying primary transfer bias 54*a*, 54*b*, 54*c* and 54*d* respectively.

Below the image forming stations, there is provided an intermediate transfer belt 51, a secondary transfer opposed roller 56, a secondary transfer roller 57, a sheet feed cassette 8, a feed roller 81, conveying path rollers 82, a fixing apparatus 7 and an intermediate transfer belt cleaner 55.

After the surfaces of the photosensitive drums 1*a* to 1*d* are uniformly charged by the charging rollers 2*a* to 2*d*, electrostatic latent images are formed on their surfaces by exposure performed by the exposure apparatus 3*a* to 3*d* in accordance with image signals. Then, the electrostatic latent images on the respective photosensitive drums are developed by the developing apparatus 4*a* to 4*d* as toner images. The toner images on the photosensitive drums 1*a* to 1*d* are primarily transferred sequentially onto the intermediate transfer belt 51, which is rotating in the direction indicated by arrow R5, at a primary transfer nip portion T1 by the aid of primary transfer biases applied to the primary transfer rollers 53*a* to 53*d* by the primary transfer bias applying power sources 54*a* to 54*d*. The transferred toner images are superposed on the intermediate transfer belt 51.

The toner remaining on the photosensitive drums (i.e. transfer residual toner) that has not been transferred to the intermediate transfer belt 51 is removed by the cleaning apparatus 6*a* to 6*d*.

The toner images of four colors having been transferred on the intermediate transfer belt 51 are secondarily transferred onto a recording material P (e.g. a paper sheet) at a secondary transfer nip portion T2 at one time with the aid of a secondary transfer bias applied between the secondary transfer opposed roller 56 and the secondary transfer roller 57. The recording material P is fed from the interior of the sheet feed cassette 8 to the secondary transfer nip portion T2 by means of the feed roller 81 and the conveying rollers 82 etc. The toner remaining on the intermediate transfer belt 51 (i.e. transfer residual toner) is removed and collected by the intermediate transfer belt cleaner 55.

The toner images on the recording material P are heated and pressurized in the fixing apparatus 7 by a fixing roller 71 having a heater 73 disposed in the interior thereof and a pressure roller 72 so as to be fixed on the surface of the recording material P. Thus a four-color process full color image is formed.

In the image forming apparatus shown in FIG. 9, the primary transfer means utilizes a contact electrification (or charging) process that uses transfer rollers 53*a* to 53*d* in the form of elastic rollers. This process is conventionally used in many image forming apparatus that use an electrophotography process, since it is low in cost and it does not generate ozone.

However, in the aforementioned type of transfer rollers 53*a* to 53*d*, it is difficult to suppress a variation in the electric resistance at the time of manufacturing and the resistance is liable to vary due to a change in environmental temperature and humidity or aged deterioration. With the transfer rollers 53*a* to 53*d* as such, in the case that a constant current control is effected with respect to the transfer bias so that a prescribed transfer current would always flow, the transfer voltage varies depending on the printing ratios of transferred toner images, so that in some cases, images are not be transferred optimally. In view of this, the following arrangement has been conventionally adopted in order to always realize a prescribed transfer current by a constant voltage control. That is an arrangement provided with control means that can effect both a constant current control and a constant voltage control on the primary bias applying power source and detecting means for detecting the voltage and current under those control, wherein the transfer bias is controlled by the constant current control during pre-rotation in the image forming process in which a toner image is not formed on the photosensitive drum 1*a* to 1*d*, and an optimal transfer voltage for the charge potential of the photosensitive drum 1*a* to 1*d* and the value of the resistance of the transfer roller 53*a* to 53*d* are determined, so that upon transferring a toner image, the constant voltage control is effected with the determined transfer voltage. This is a control process called ATVC, with which a necessary transfer current flow can be realized under a constant voltage control.

On the other hand it has also been performed conventionally to form a predetermined test pattern (as a toner image) during a period other than normal image forming period so that an image control such as a density control of an image would be performed by measuring the reflection density of the test pattern.

Generally, upon forming a toner image on a photosensitive drum, the toner is developed with development contrast as shown in FIG. 10. In the graph of FIG. 10, the abscissa axis represents the DC voltage of the charging bias applied to the charging roller 2*a* to 2*d* and the ordinate axis represents the surficial charge potential (surface potential) of the photosensitive drum 1*a* to 1*d*. Vd represents the surficial charge potential of the photosensitive drum 1 charged by the charging roller 2*a* to 2*d* (i.e. dark portion potential) and Vl represents the surficial charge potential of the area of the photosensitive drum that has been exposed by the exposure apparatus 3*a* to 3*d* (i.e. bright portion potential). Vdc is the developing bias applied to the developing apparatus 4*a* to 4*d*. The development contrast is, as shown in FIG. 10, the potential difference between the DC component Vdc of the developing bias and the bright portion potential Vl of the photosensitive drum 1*a* to 1*d*. There is such a correlation between the development contrast and the toner bearing amount that the larger the development contrast is, the larger amount of toner is developed on the surface of the photosensitive drum 1*a* to 1*d*.

However, the bright portion potential Vl of the photosensitive drum 1*a* to 1*d* varies greatly depending on environmental temperature and humidity or the degree of endurance of the photosensitive drum 1*a* to 1*d*. Therefore, it is difficult to determine the development contrast precisely. In view of this, in the case that precise information on the development contrast in relation to the toner bearing amount is required as is the case upon forming a test pattern for density control, a toner image is formed, differently to the above described image formation process, by a process called analogue development in which precise information on the development contrast can be obtained.

In that process, as shown in FIG. 11, the surface of the photosensitive drum 1*a* to 1*d* is charged by the charging roller 2*a* to 2*d* up to a predetermined dark portion potential Vd and a developing bias with a DC component value Vdc larger than Vd is applied to the developing apparatus 4*a* to 4*d* with negative polarity. A negatively charged toner image is developed by the development contrast as the difference between the dark portion potential Vd and the developing bias Vdc at that time. Thus, precise information on the development contrast is obtained without an influence of the bright portion potential that is liable to vary due to changes of the photosensitive drum 1*a* to 1*d* caused by the environments or the endurance, so that it is possible to obtain a test pattern corresponding to the development contrast.

Upon detecting the toner bearing amount of the test pattern formed on the photosensitive drum 1*a* to 1*d* by means of a reflective density sensor or the like, it is difficult in the case of the image forming apparatus that uses a photosensitive drum of a small diameter to arrange the aforementioned reflective sensor for detecting the test pattern on the photosensitive drum. On the other hand, if the aforementioned reflective density sensor is to be arranged on the photosensitive drum, four reflective density sensors are required in the case of the image forming apparatus provided with photosensitive drums for four colors (i.e. four photosensitive drums). This leads to the problem of an increase in the cost. In view of the above, there has been conventionally performed a method in which a test pattern formed on a photosensitive drum is once transferred onto the intermediate transfer belt 51 and the transferred test pattern is detected by a reflective density sensor disposed in the vicinity of the intermediate transfer belt 51.

Japanese Patent Application Laid-Open No. 11-109689 discloses a method in which upon normal image formation, a transferring bias is controlled based on a change in the voltage applied to charging means. This method is to maintain an optimum transferring bias, even when Vd varies by changing the charging conditions due to change in temperature and humidity in the environment, by setting the transferring voltage Vtr in such a way that the transferring contrast between Vtr and Vd becomes always constant as shown in FIG. 12.

However, studies made by the inventors revealed that in the case that a toner image formed by analogue development is transferred onto an intermediate transfer belt 51, an optimal transferred image cannot be obtained even when the transferring bias Vtr is set in such a way that the transfer contrast between Vtr and Vd becomes constant in the manner described above.

This is because in the case of analogue development, toner images are formed in the area of the dark portion potential Vd shown in FIG. 11, while toner images developed in the normal image formation process are formed in the area of the bright portion potential Vl of the photosensitive drum as shown in FIG. 10.

Therefore, even when the transferring voltage is optimum for Vl, the transferring contrast is different for Vd with which analogue development is performed, and so the transferring of a test pattern is not performed optimally. Consequently, there is a problem that image control cannot be performed correctly.

SUMMARY OF THE INVENTION

The present invention was made in view of the above-described situations, and an object of the present invention is to provide an image forming apparatus, which is capable of optimizing transferring conditions of a test pattern.

According to a preferred aspect of the present invention for attaining the above object, there is provided an image forming apparatus comprising:

charging means for charging an image bearing member;

exposure means for exposing the image bearing member that has been charged to form an electrostatic latent image;

developing means for developing the electrostatic latent image with developer;

transferring means to which a transferring bias under constant voltage control is applied to transfer a developer image on the image bearing member onto the other member;

test pattern forming means for forming a test pattern for image control on the image bearing member by supplying developer by the developing means to an area on the image bearing member in which charging by the charging means is effected and exposure by the exposure means is not effected;

test pattern detection means for detecting the test pattern that has been transferred to other member by the transferring means; and control means for setting a value of the transferring bias upon transferring of the test pattern onto the other member in accordance with a surface potential of the image bearing member upon formation of the test pattern.

According to another preferred aspect of the present invention, there is provided an image forming apparatus comprising:

charging means, to which a charging bias is applied, for charging an image bearing member;

exposure means for exposing the image bearing member that has been charged to form an electrostatic latent image;

developing means for developing the electrostatic latent image with developer;

transferring means, to which a transferring bias under constant voltage control is applied, for transferring a developer image on the image bearing member onto other member;

test pattern forming means for forming a test pattern for image control on the image bearing member by supplying developer by the developing means to an area on the image bearing member in which charging by the charging means is effected and exposure by the exposure means is not effected;

test pattern detection means for detecting the test pattern that has been transferred to the other member by the transferring means; and control means for setting a value of the transferring bias upon transferring of the test pattern onto the other member in accordance with a value of the charging bias applied to the charging means upon formation of the test pattern.

According to another preferred aspect of the present invention, there is provided an image forming apparatus comprising:

charging means for charging an image bearing member;

exposure means for exposing the image bearing member that has been charged to form an electrostatic latent image;

developing means, to which a developing bias is applied, for supplying the image bearing member with developer;

transferring means, to which a transferring bias under constant voltage control is applied, for transferring a developer image on the image bearing member onto other member;

test pattern forming means for forming a test pattern for image control on the image bearing member by supplying developer by the developing means to an area on the image bearing member in which charging by the charging means is effected and exposure by the exposure means is not effected;

test pattern detection means for detecting the test pattern that has been transferred to the other member by the transferring means; and control means for setting a value of the transferring bias upon transferring of the test pattern onto the other member in accordance with a value of the developing bias upon formation of the test pattern.

DETAILED DESCRIPTION OF THE EMBODIMENTS

Figure 1:
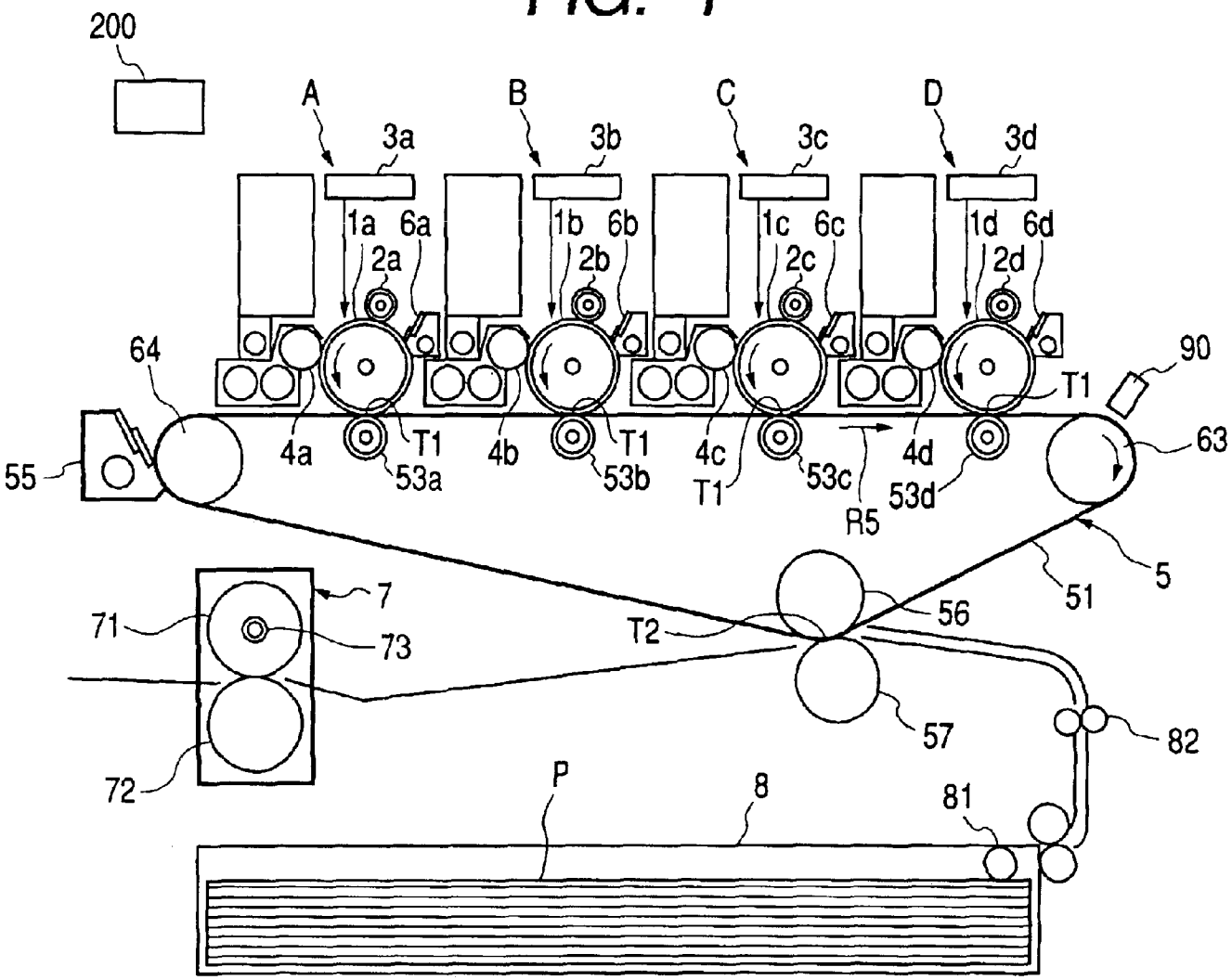
FIG. 1 is a longitudinal sectional view schematically showing the structure of an image forming apparatus according to an embodiment 1.

In the following, embodiments of the present invention will be described with reference to the accompanying drawings. In connection with this, elements in the drawings designated with the same reference sign have the same structure and function, and redundant descriptions thereof will be omitted, where appropriate.

Embodiment 1

FIG. 1 shows an image forming apparatus according to embodiment 1 as an example of the image forming apparatus according to the present invention. The image forming apparatus is a full color image forming apparatus using a four-color process and an electrophotography process and provided with four image forming stations and an intermediate transfer member.

The four image forming stations (or process units) A, B, C and D are disposed in the mentioned order from the upstream of the rotation direction (i.e. the direction indicated by arrow R5) of an intermediate transfer belt 51 serving as an intermediate transfer member (or other member) to form toner images (images) of respective colors, namely yellow (Y), magenta (M), cyan (C) and black (K) respectively.

The image forming stations have photosensitive drums 1*a*, 1*b*, 1*c* and 1*d* serving as image bearing members respectively. Around the respective photosensitive drums 1*a* to 1*d*, there is provided, in the following order substantially along their rotation direction (i.e. the counterclockwise direction), charging rollers (serving as charging means) 2*a*, 2*b*, 2*c* and 2*d*, exposure apparatus (serving as exposure means) 3*a*, 3*b*, 3*c* and 3*d*, developing apparatus (serving as developing means) 4*a*, 4*b*, 4*c* and 4*d*, primary transfer rollers (serving as transfer means) 53*a*, 53*b*, 53*c* and 53*d*, and cleaning apparatus (serving as cleaning means) 6*a*, 6*b*, 6*c* and 6*d*.

Figure 2:
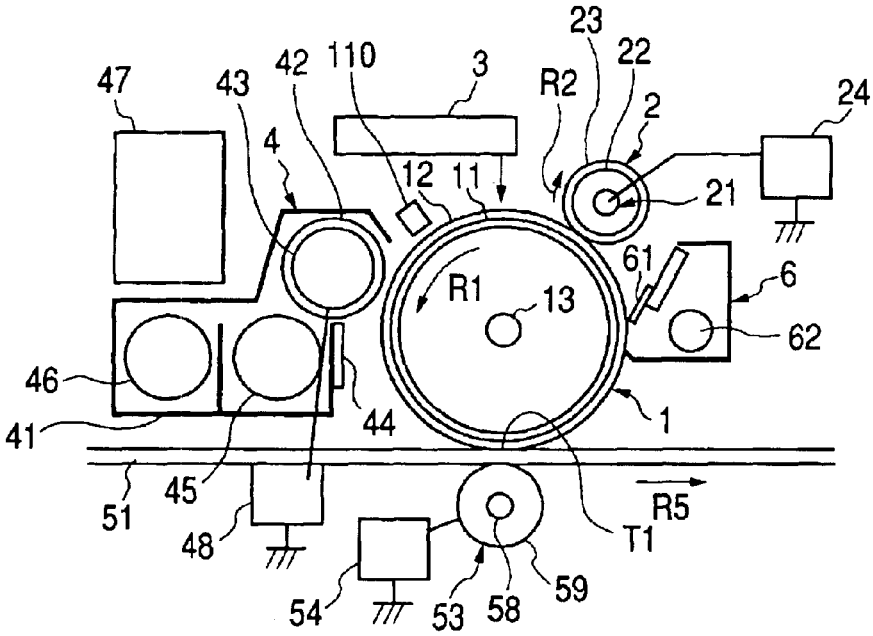
FIG. 2 is an enlarged view showing one of image forming stations in the apparatus shown in FIG. 1.

The four image forming stations A, B, C and D have the same structure. An enlarged view of one of the image forming stations is presented as FIG. 2. In FIG. 2, suffixes a, b, c and d in the reference signs for distinguishing the image forming stations are omitted.

The image forming station is provided with a drum type electrophotography photosensitive member (i.e. the photosensitive drum) 1 serving as an image bearing member. The photosensitive drum 1 is an OPC photosensitive member having a cylindrical shape composed basically of an electroconductive base member 11 made of aluminum or the like, a photoconductive layer 12 formed on the outer surface of the electro-conductive base member 11 and a support shaft 13 disposed at the center. The photosensitive drum 1 is rotatably supported, by means of the support shaft 13, on the body (not shown) of the image forming apparatus so that the photosensitive drum 1 would be driven by driving means (not shown) to rotate in the direction indicated by arrow R1 at a predetermined process speed (i.e. peripheral speed) with the support shaft 13 being the center of rotation.

The charging roller 2 serving as charging means is disposed above the photosensitive drum 1. The charging roller 2 is constructed in the form of a roller as a whole and in contact with the surface of the photosensitive drum 1 to uniformly charge the surface to a negative electric potential. The charging roller 2 is composed of an electro-conductive metal core 21 disposed at the center, an electro-conductive layer 22 having a low resistance and an electro-conductive layer 23 having a medium resistance both of which are arranged on the outer periphery of the metal core 21. The metal core 21 is rotatably supported at both end portions by bearing members (not shown) and disposed parallel to the photosensitive drum 1. The bearing members at both ends are biased by pressing means (not shown) toward the photosensitive drum 1, so that the charging roller 2 is brought into pressure contact with the surface of the photosensitive drum 1 with a predetermined pressurizing force. With the rotation of the photosensitive drum 1 in the direction or the arrow R1, the charging roller 2 is driven to rotate in the direction or the arrow R2. A charging bias is applied to the charging roller 2 by a charging bias applying power source 24. Thus, the charging roller 2 is adapted to charge the surface of the photosensitive drum 1 uniformly while being in contact with the photosensitive drum 1.

The type of the charging means is not limited to the above-described one, but it may be the other type of a contact type charging member or a non-contact type corona charger.

The exposure apparatus 3 is disposed in the downstream of the charging roller 2 with respect to the rotation direction of the photosensitive drum 1. The exposure apparatus 3 is to scan and expose the photosensitive drum 1 with a laser beam while turning on and off the laser beam based, for example, on image information so as to form an electrostatic latent image corresponding to the image information.

The developing apparatus 3 serving as developing means is disposed in the downstream of the exposure apparatus and provided with a developing container 41 accommodating two component developer including carrier and toner and a developing sleeve 42 rotatably disposed at the opening of the developing container 41 that is opposed to the photosensitive drum 1. A magnet roller 43 for retaining the developer borne on the developing sleeve 42 is fixedly disposed in the interior of the developing sleeve 42 in such a way as to be non-rotatable irrespective of the rotation of the developing sleeve 42. At a position beneath the developing sleeve 42 in the developing container 41, there is provided a regulation blade 44 for regulating the developer borne by the developing sleeve to form it into a thin developer layer. In addition, a developing chamber 45 and an agitating chamber 46 that are partitioned are provided in the developing container 41. Above those chambers 45 and 46, there is provided a replenishing chamber 47 accommodating toner for replenishment. The developer borne as a thin developer layer on the developing sleeve 42 is carried to a developing area (or developing portion) opposed to the photosensitive drum 1. In the developing area, the developer forms magnetic bead chains (i.e. bristles) due to a magnetic force applied by developing main pole (not shown) of the magnet roller 4 disposed in the developing area, so that a magnetic brush made of the developer is formed. The magnetic brush slides on the surface of the photosensitive drum 1 while a developing bias is applied to the developing sleeve 42 by the developing bias applying power source 48. In that process, the toner adhering to the carrier in the developer constituting the bristles of the magnetic brush attaches to the exposed portion of an electrostatic latent image to develop the image. Thus a toner image is formed on the photosensitive drum 1.

The structure of the developing means is not limited to the above-described one, but it may be a structure that uses one component developer or a structure that does not use a magnet.

A transfer roller 53 serving as transfer means is disposed in the downstream of the developing apparatus 4 and beneath the photosensitive drum 1. The transfer roller 53 is composed of a metal core 58 to which a bias is applied by a (primary) transfer bias applying power source 54 and a cylindrical semi-conductive layer 59 formed on the outer peripheral surface of the metal core 58. The transfer roller 53 is biased at its both end portions toward the photosensitive drum 1 by means of a pressing member such as a spring (not shown), so that the semi-conductive layer 59 is brought into pressure contact with the surface of the photosensitive drum 1 with the intermediate transfer belt between with a predetermined pressurizing force. With this structure, a primary transfer nip portion T1 is formed between the photosensitive drum 1 and the intermediate transfer belt 51. The intermediate transfer belt 51 is held or pinched in the primary transfer nip portion T1, and a transfer bias voltage having the polarity reverse to that of the toner is applied by the transfer bias applying power source 54. Thus, the toner image on the photosensitive drum 1 is primarily transferred onto the intermediate transfer belt 51. The transfer bias applying power source 54 is provided with a circuit for detecting the transferring current in order to perform the above-mentioned ATVC control for setting an optimum transferring voltage.

The transfer means is not limited to the above-described transfer roller, but a contact type transfer member such as a blade may also be used. Alternatively, a non-contact corona charger may also be used.

After the image transfer, the photosensitive drum 1 is cleaned by the cleaning apparatus 6, so that particles such as transfer residual toner adhering to the photosensitive drum 1 are removed. The cleaning apparatus 6 has a cleaning blade 61 and a carrying screw 62. The cleaning blade 61 is arranged to be in contact with the photosensitive drum 1 at a predetermined angle and a predetermined pressure by pressurizing means (not shown) so as to collect transfer residual toner etc. remaining on the surface of photosensitive drum 1. The collected transfer residual toner etc. is carried by the carrying screw 62 so as to be discharged.

In the arrangement shown in FIG. 1, an intermediate transfer unit 5 is provided beneath the photosensitive drums 1*a* to 1*d*. The intermediate transfer unit 5 includes the intermediate transfer belt (i.e. intermediate transfer member) 51, the primary transfer rollers 53*a*, 53*b*, 53*c* and 53*d*, a secondary transfer opposed roller 56, a secondary transfer roller 57 and an intermediate transfer belt cleaner 55 etc. The intermediate transfer belt 51 is looped around a driving roller 63, a tension roller 64 and the secondary transfer opposed roller 56 and pressed against the photosensitive drums 1*a* to 1*d* by the primary transfer rollers 53*a* to 53*d* from the backside. With the above-described structure, the intermediate transfer belt 51 forms primary transfer nip portions T1 with the photosensitive drums 1*a* to 1*d*. The intermediate transfer belt 51 is adapted to be driven to rotate in the direction indicated by arrow R5 with the rotation of the driving roller 63 in the direction indicated by an arrow (i.e. clockwise rotation).

The toner images of respective colors formed on the photosensitive drums 1*a* to 1*d* are primarily transferred sequentially onto the intermediate transfer belt 51 in the respective primary transfer nip portions T1 while transferring biases are applied by the primary transfer rollers 53*a* to 53*d* that are opposed to the photosensitive drums 1*a* to 1*d* with the intermediate transfer belt 51 between, so that the toner images are superposed on the intermediate transfer belt 51. The toner images of four colors on the intermediate transfer belt are carried to the secondary transfer nip portion T2 with the rotation of the intermediate transfer belt 51 in the direction indicated by arrow R5.

On the other hand, by that time, a recording material P accommodated in a sheet feed cassette 8 has been conveyed to a conveying roller 82 by a feed roller 81 and further conveyed in the left direction in FIG. 1 so as to be fed to the secondary transfer nip portion T2. In the secondary transfer nip portions T2, the toner images of four colors on the intermediate transfer belt 51 are secondarily transferred at one time onto the recording material fed to the secondary transfer nip portion T2 by the aid of a secondary transferring bias applied between the secondary transfer opposed roller 56 and the secondary transfer roller 57. Transfer residual toner untransferred to the recording material P remaining on the intermediate transfer belt 51 is removed and collected by the intermediate transfer belt cleaner 55.

The aforementioned intermediate transfer belt 51 is made of a dielectric resin such as polycarbonate (PC), polyethylene terephthalate (PET) or Polyvinylidene fluoride (PVDF). In this embodiment, a polyimide (PI) resin having a volume resistivity of $10^{8.5}$ Ω·cm (measured by using a probe compliant with Japanese Industrial Standards (JIS) K6911 with application of a voltage of 100 V, application time of 60 sec, a temperature of 23° C. and relative humidity of 50% RH) and a thickness "t" of 100 μm was used, but other materials having different volume resistivity and thickness may also be used.

Each of the primary transfer rollers 53*a* to 53*d* is composed of a metal core 58 having a diameter of 8 mm and an electro-conductive urethane sponge layer having a thickness of 4 mm serving as the semi-conductive layer 59. The resistance of the primary transfer roller 53*a* to 53*d* is determined based on the relationship between a voltage and a current that are measured under application of a voltage of 50 V to the metal core 58 while the transfer roller 53*a* to 53*d* is rotated at a peripheral speed of 50 mm/sec relative to the earth under a load of 500 g-wt. The value was about $10^6$ Ω (under the condition of temperature=23° C. and humidity= 50% RH).

The fixing apparatus 7 is provided with a fixing roller 71 that is rotatably disposed and a pressurizing roller 72 that rotates while in pressure contact with the fixing roller 71. In the interior of the fixing roller 71, there is provided a heater 73 such as a halogen lamp, so that the temperature of the surface of the fixing roller 71 is controlled by controlling, for example, the voltage applied to the heater 73. Under this condition, when the recording material P is delivered to the fixing apparatus 7, the fixing roller 71 and the pressurizing roller 72 are rotated at a constant speed, and the recording material P is pressurized and heated at substantially constant pressure and temperature from both sides as it passes between the fixing roller 71 and pressurizing roller 72, so that the unfixed toner images on the surface of the recording material P is fusion-bonded (i.e. fixed). Thus, a four-color process full color image is formed on the recording material.

Furthermore, the full color image forming apparatus according to the present embodiment is provided with a mechanism for adjusting the density of output images and control means for automatically controlling the output image density appropriately. Particularly, in an image forming apparatus that outputs four-color process full color images like the apparatus of the present embodiment, precise density control is desired for each of the colors of yellow, magenta, cyan and black in order to realize desired color balance.

In this embodiment, a reflective density sensor 90 is used as density detection means used for density control. The reflective density sensor is arranged in such a way as to be opposed to the portion of the intermediate transfer belt 51 that is hanging on the driving roller 63. Such an arrangement is made with a view to prevent the distance between the reflective density sensor 90 and the intermediate transfer belt 51 from being varied.

Figure 3:
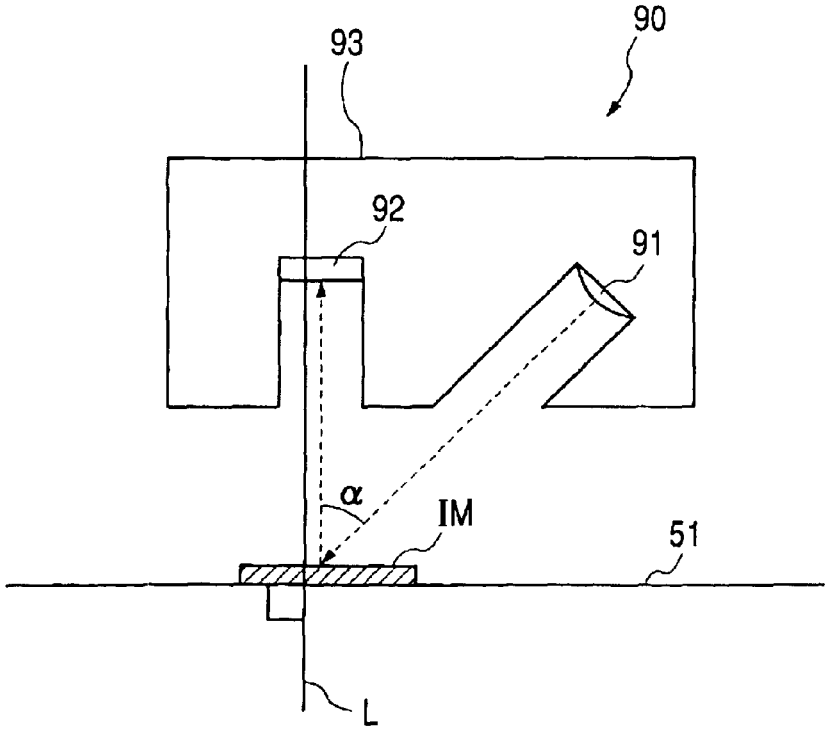
FIG. 3 is a sectional view showing the structure of a reflective light quantity sensor.

FIG. 3 is an enlarged view showing the reflective density sensor 90. The reflective density sensor is provided with a light emitting element 91 such as an LED, a light receiving element 92 such as a photodiode and a holder supporting these elements. Infrared light emitted from the light emitting element 91 is directed to a test pattern IM on the intermediate transfer belt 51 and the reflected light from the test pattern IM is measured by the light receiving element 92, so that the density of the test pattern IM is measured. In this reflective density sensor 90, in order to prevent regular reflection light from the test pattern IM from entering the light receiving element 92, the irradiation angle α to the test pattern IM is set to 45° and the receiving angle of the reflection light from the test pattern IM is set to 0° with respect to the normal line L, so that only irregular reflection light is measured. The amount of the infrared light received by the reflective density sensor 90 is substantially proportional to the amount of the toner adhering on the surface of the intermediate transfer belt 51 (adhering toner amount), and so the adhering toner amount and the density of the output image correlate with each other on one to one basis. Therefore, the density of the test pattern IM can be estimated from the measurement value of the reflective density sensor 90.

In the above-described image forming apparatus, toner images (i.e. normal toner images) are formed on the exposed areas on the photosensitive drum. In other words, the toner images are formed at the portions that have been exposed to light by the exposure apparatus.

Next, a description will be made of formation and transferring of a test pattern utilizing analogue development in the image forming apparatus according to the present embodiment. In the image forming apparatus shown in FIG. 1, the test pattern is the same irrespective of on which photosensitive drums 1*a*, 1*b*, 1*c*, 1*d* in the respective image forming stations A, B, C and D for yellow, magenta, cyan and black the test pattern is formed, and therefore suffixes a, b, c and d for distinguishing the colors will be omitted in the following description. In the following description, the unit of electric potentials and voltages will be volt (V), unless otherwise stated.

Formation of Test Pattern (i) The surface of the photosensitive drum 1 shown in FIG. 1 is charged by the charging roller 2 up to a predetermined charge potential (i.e. dark portion potential). In this embodiment, the charging roller 2 is used as the charging apparatus, and the surface of the photosensitive drum 1 is charged with a value close to the DC component of the charging bias applied to the charging roller 2.

Figure 11:
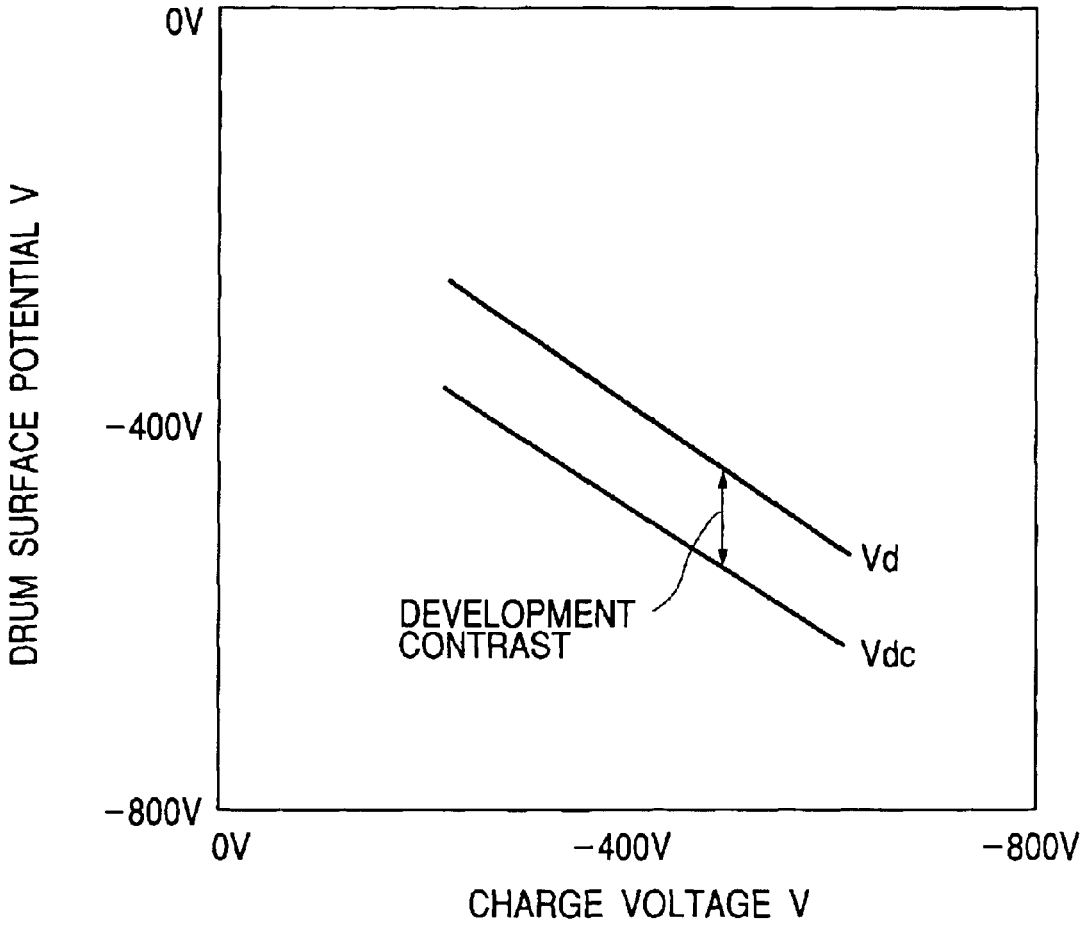
FIG. 11 is a graph showing a relationship between a charge potential (i.e. dark portion potential) of the photosensitive drum and a developing bias upon analogue development in the conventional image forming apparatus.
Figure 12:
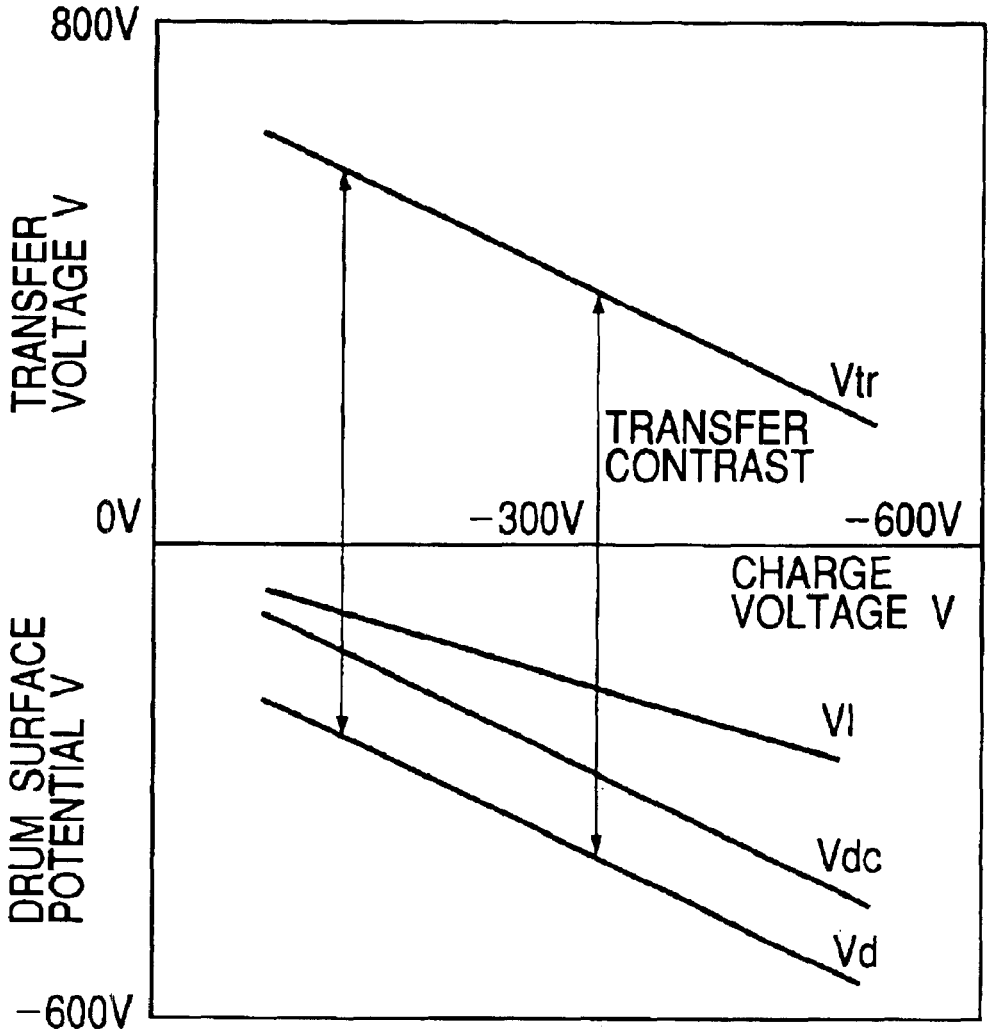
FIG. 12 is a graph showing a relationship of charge potentials (including a dark portion potential and bright portion potential) of a photosensitive drum, a developing bias and a transferring bias in the conventional image forming apparatus.

(ii) The toner image is developed on the surface of the photosensitive drum 1 that has been charged up to a charge voltage Vd' while a developing bias Vdc' is applied to the developing apparatus 4. In this process, the applied developing bias Vdc' has negative polarity, which is the same as the polarity of the charge potential Vd', and an absolute value larger than that of the charge potential Vd' as shown in FIG. 11. The toner, which is negatively charged, is developed by a development contrast defined as the difference between the charge potential Vd' and the developing bias Vdc'. Here, a normal image forming process (i.e. a process for forming an image) is not performed. In other words, a normal image forming process including performing an exposure with the exposure apparatus 3 after the photosensitive drum 1 is charged and developing the exposed portion by attaching toner etc. is not performed. Accordingly, the test pattern is formed in a non-image formation area (i.e. an area in which no image is formed). This is because in order to avoid the influence of a variation in the potential (i.e. bright portion potential) Vl of the exposed portion, as described before.

Transferring of Test Pattern

Prior to the description of a method for setting an optimum transferring bias for the test pattern, the detail of a method (ATVC) for setting the transferring bias for a normal image will be first described.

(i) The surface of the photosensitive drum 1 shown in FIG. 2 is charged by the charging means 2 up to Vd.

Figure 4:
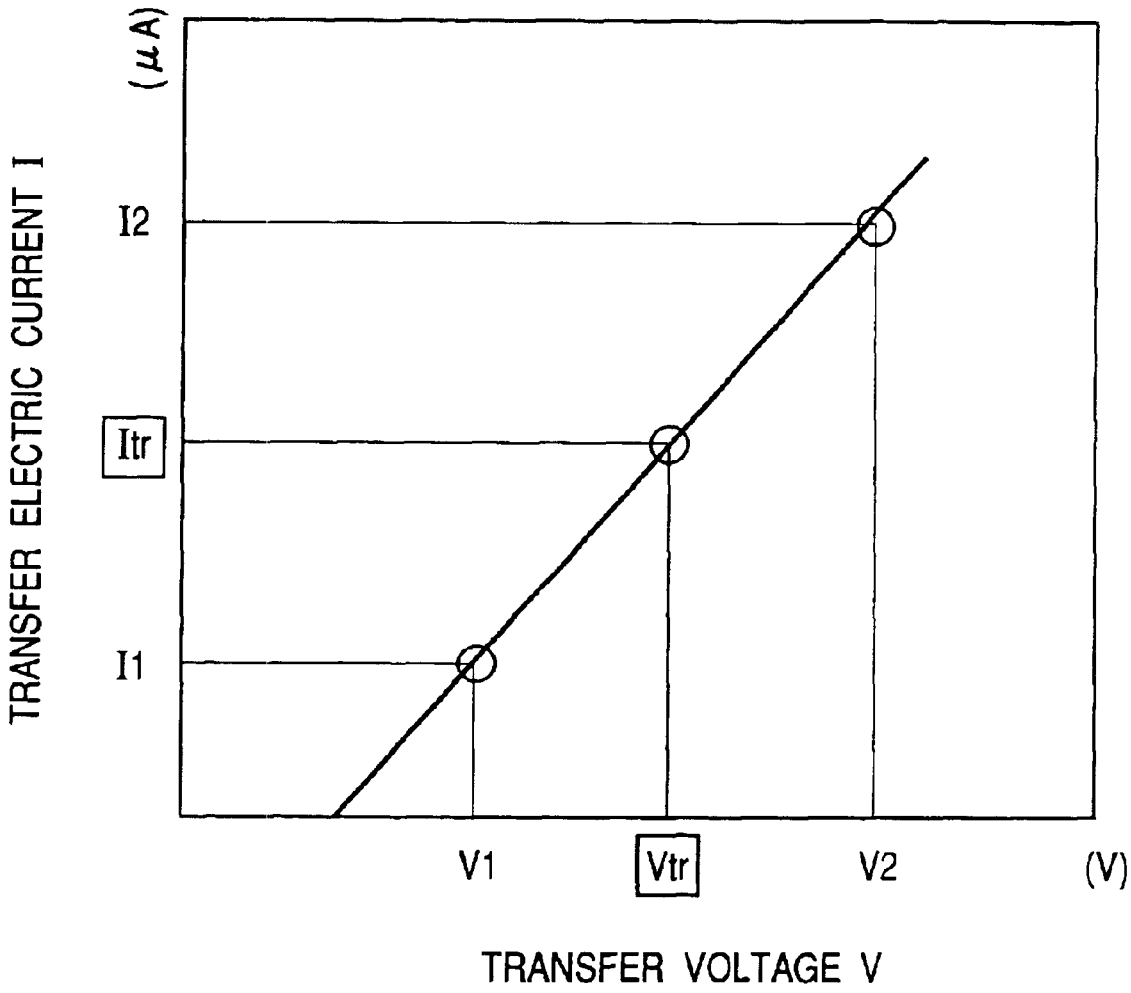
FIG. 4 is a graph showing a relationship between the transferring voltage and the transferring current in an ATVC process in the embodiment 1.

(ii) When the area of the surface of the photosensitive drum 1 that has been charged to Vd reaches the primary transfer nip portion T1, predetermined biases are sequentially applied by means of the primary transfer roller 53, so that an optimum transferring voltage Vtr is determined. While there are several ways of determining the optimum transferring voltage, here, predetermined biases V1 and V2 are applied during one rotation of the primary transfer roller 53, and the transferring current at that time is measured. Then, the average values I1 and I2 of the current values during one rotation of the primary transfer roller 53 are obtained, and a voltage Vtr required for generating an optimum transfer current Itr is determined by linear interpolation based on these values as shown in FIG. 4. In connection with this, it is known that the transfer efficiency of a toner image generally depends on the transferring current flowing upon transferring of the toner image. However, it is not desirable to perform the ATVC while transferring a toner image from the viewpoint of toner consumption or other reasons. In view of the above situations, here, the transferring current Itr that flows with the transferring voltage that attains the highest transfer efficiency upon transferring a toner image when a non-image area, which is an area of the surface of the photosensitive drum 1 that is charged up to Vd, arrives at the primary transfer nip portion T1 has been determined in advance by an experiment, so that the transferring voltage Vtr that attains the highest transfer efficiency upon transferring a toner images is ensured by ensuring the transferring current Itr for the non-image area.

(iii) In the case that a normal image is transferred, an optimal transferred image can be obtained by performing a constant voltage control with the voltage Vtr obtained in the above-described manner.

Next, a method of setting an optimum transferring bias for a test pattern will be described.

Figure 6:
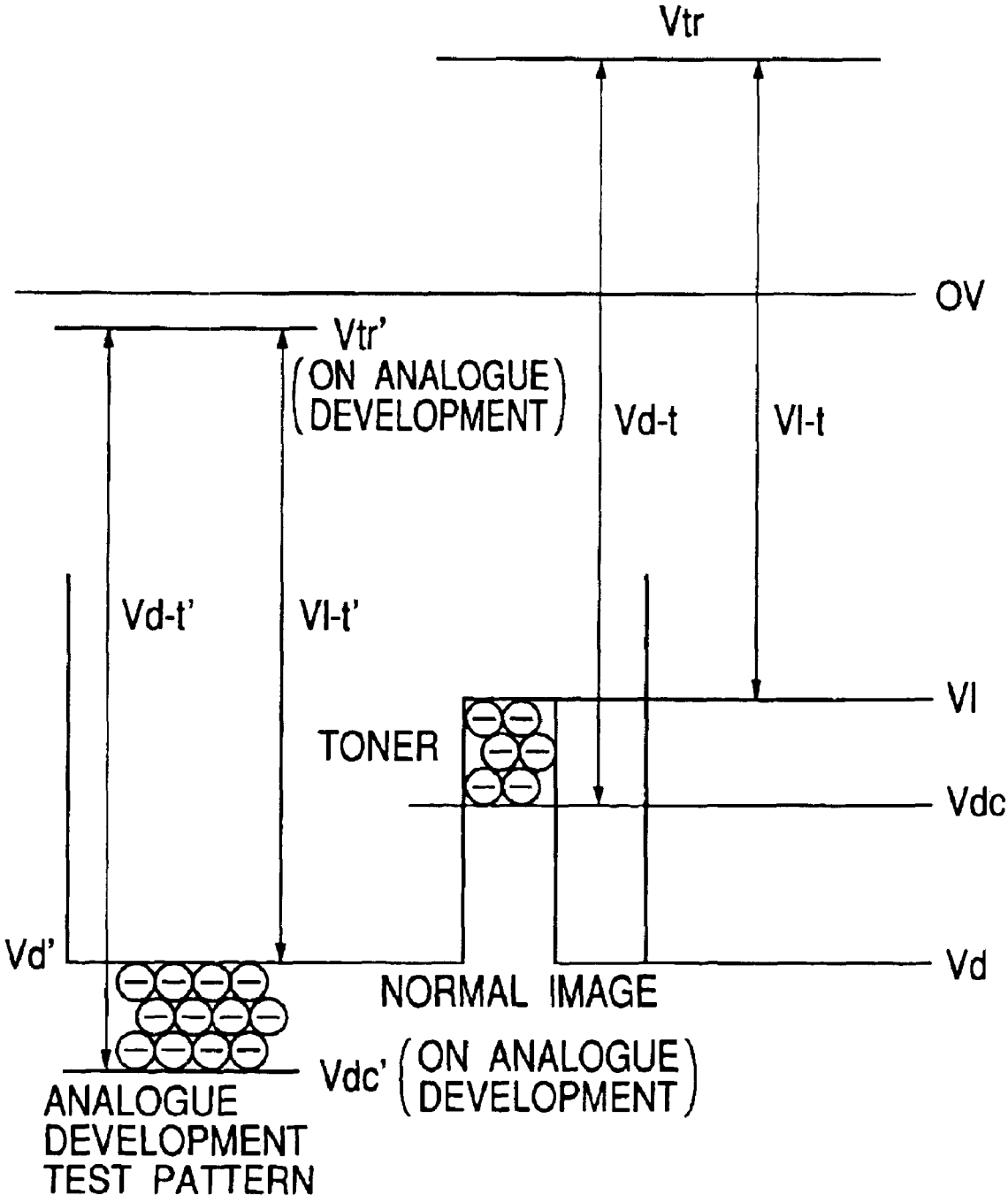
FIG. 6 is a diagram showing a relationship of charge potentials (including a dark portion potential and bright portion potential) of a photosensitive drum, a developing bias and a transferring bias in a conventional image forming apparatus.

The right part of FIG. 6 shows a relationship of the dark portion potential Vd or the potential of the charged area of the surface of the photosensitive drum 1, the bright portion potential Vl or the potential of the portion of the surface of the photosensitive drum 1 that has been charged and then exposed and the DC component of the developing bias applied to the developing apparatus 4 upon forming a normal image (i.e. at the time of image formation). As described before, a toner image is developed by a development contrast defined as the potential difference between Vdc and Vl. In addition, the transferring bias upon transferring a normal image is Vtr that has been determined in the above-described manner.

On the other hand, the left part of FIG. 6 shows a relationship of the dark portion potential Vd' (equal to Vd) of the photosensitive drum 1 and the developing bias Vdc' applied to the developing apparatus upon forming a test pattern by analogue development. Upon analogue development, a developing bias Vdc' that has negative polarity, which is the same as the polarity of Vd, and an absolute value larger than that of Vd' is applied, so that the toner image is developed by the development contrast of Vd' and Vdc'.

In the case that an analogue development test pattern is to be transferred, an optimal transferred image can be obtained with a setting with which the optimum transferring current Itr same as that upon transferring a normal image would pass.

As a result of studies on transferring bias settings for test patterns formed by analogue development, it turned out that so long as the potential difference between the surface potential Vl of the area on a photosensitive member in which a toner image has been developed and the transferring bias Vtr is substantially the same, the transferring current remains substantially the same even if the absolute value of the surface potential Vl of the photosensitive member and the absolute value of the transferring bias Vtr are varied, so that an optimal transferring can be performed. Specifically, letting l-t represent the potential difference (i.e. the contrast) between the surface potential Vl of the area on the photosensitive member in which a toner image has been developed and the transferring bias Vtr upon formation of a normal image and letting l-t represent the potential difference (i.e. the contrast) between the surface potential Vd of the area on the photosensitive member in which a toner image has been developed and the transferring bias Vtr upon analogue development, an optimal transferred image can be obtained by setting Vtr in such a way that the former potential difference Vl-t and the latter potential difference Vl-t would become the same. Therefore, the above-described method is effective in the image forming apparatus that is capable of precisely detecting the surface potential Vl of the area on the photosensitive member in which a toner image has been developed. Described more specifically with reference to FIG. 2, this method is effective in the image forming apparatus that has means 110 for detecting the surface potential of the photosensitive drum 1 after the surface of the photosensitive drum 1 is exposed upon passing by the exposure means 3. However, there are image forming apparatus that do not have means 110 for detecting the surface potential of the photosensitive drum 1. In view of this, the inventors of the present invention had performed further studies, and devised the following methods that are effective to structures that are not provided with means for detecting the surface potential of the photosensitive drum 1.

A first method is to use, instead of the surface potential value Vd or Vd' of a photosensitive member, the value Vpre of the DC component of the bias applied to a charging roller for charging the surface of the photosensitive member. This is based on the fact that the surface potential of the photosensitive member correlates with the bias value applied to the charging roller. In other words, when a bias of Vpre is applied, the surface potential becomes Vd, and when a bias of Vpre' is applied, the surface potential becomes Vd'.

A second method is to use, instead of the surface potential value Vd or Vd' of a photosensitive member, the value Vpre of the DC component of the developing bias. The relationship between the DC component Vdc of the developing bias and the surface potential of the area on the photosensitive member in which a toner image has been developed relates to the bearing amount of the developed toner, and it does not differ so much between at the time of normal image formation and at the time of test pattern image formation. In other words, it is considered that the condition Vdc−Vl~Vdc'−Vd' is satisfied. Therefore, so long as the potential difference between the DC component Vdc of the developing bias and the transferring bias Vtr is the same, even if the absolute value of the DC component of the developing bias and the absolute value of the transferring bias are varied, the transferring current remains substantially the same, so that an optimal transferring can be performed. Specifically, letting "Vd-t" represent the potential difference (i.e. the contrast) between the developing bias Vdc applied to the developing apparatus 4 and the transferring bias Vtr upon formation of a normal image and letting "Vd-t' " represent the potential difference (i.e. the contrast) between the developing bias Vdc' and the transferring bias Vtr' upon analogue development, an optimal transferred image could be obtained by setting Vtr' in such a way that the former potential difference Vd-t and the latter potential difference Vd-t' would become the same.

The transferring bias Vtr' for an analogue development test pattern can be calculated from the following equation:

$$Vtr'-Vdc'=Vtr-Vdc$$

that is, $$Vtr'=Vtr-Vdc+Vdc' \quad (1)$$

As per the above, the setting procedure of an optimum transferring bias for a test pattern is determined as follows:

(i) performing an ATVC during the period of pre-multiple rotation performed after the turning-on of the power or the period of pre-rotation in the normal image forming process to set a transferring bias for a normal image;

(ii) calculating Vtr' using the above equation (1) based on a developing bias Vdc' upon forming an analogue image; and (iii) performing, upon transferring the analogue image, a constant voltage control with the calculated voltage Vtr' to obtain an optimal transferred image.

By setting the transferring bias in accordance with the above procedure, an image with the highest transfer efficiency can also be obtained for a test pattern formed by analogue development. Therefore, an optimal control can also be realized in the case that a density control is performed based on a density detection of a test pattern on the intermediate transfer belt 51 by the reflective density sensor.

It should be understood that the aforementioned ATVC sequence can also be performed in a period other than the period of pre-multiple rotation performed after the turning-on of the power or the period of pre-rotation in the normal image forming process, and it may be performed, for example, when an environmental variation occurs or when a predetermined number of printing operations have been performed.

In this embodiment, the description has been made of the image forming apparatus in which a test pattern formed on the photosensitive drum 1 is transferred onto the intermediate transfer belt 51 serving as an intermediate transfer member and the reflection density of the test pattern on the intermediate transferring belt is detected. However, the method of the invention can be applied to an image forming apparatus using a direct transferring process that does not use an intermediate transferring member in which the reflection density of an image having been transferred on a transferring material such as a paper sheet or on a transferring material conveying belt etc is detected.

Figure 13:
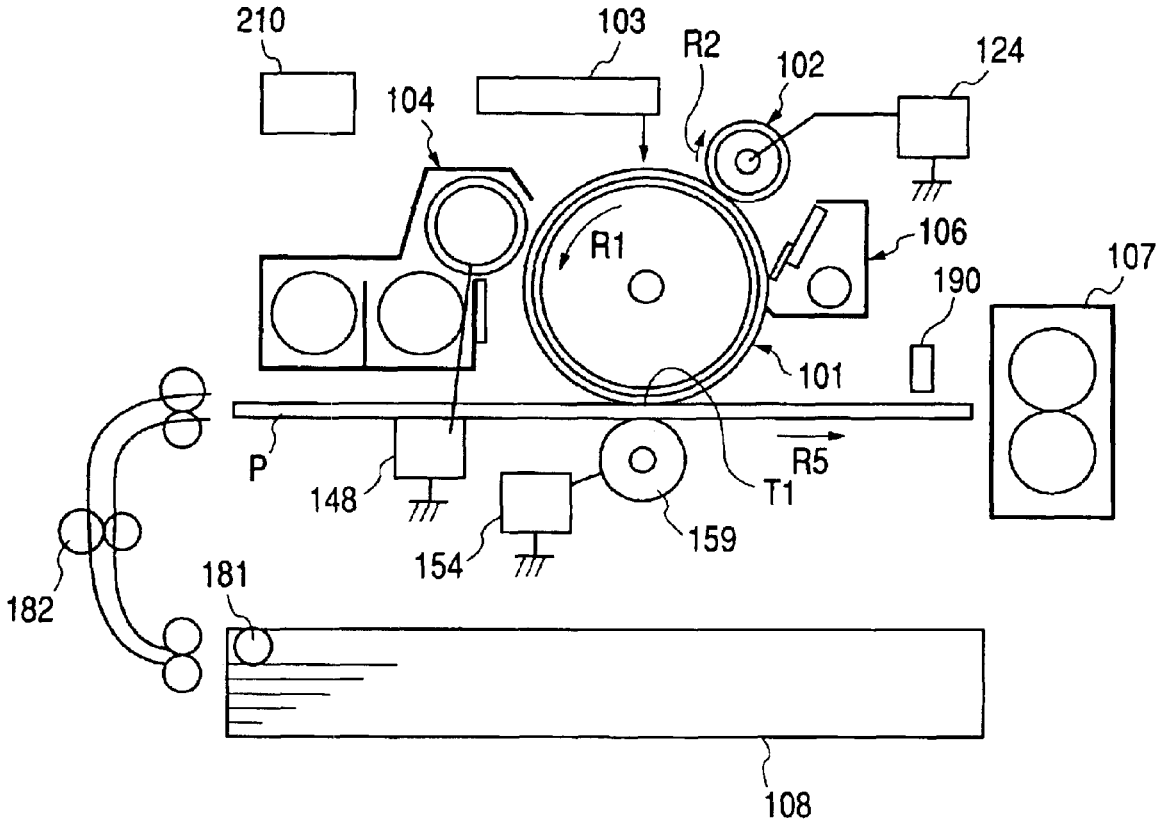
FIG. 13 is a view showing an alternative image forming apparatus according to embodiment 1.

FIG. 13 shows an example of a structure for transferring a toner image from a photosensitive drum to a transferring material.

Charging is performed on a photosensitive member 101 serving as an image bearing member by a charging roller 102 to which a predetermined bias is applied by power source 124. Exposure of the surface of the photosensitive member 101 thus charged is performed by the exposure means 103, so that an electrostatic latent image is formed. The electrostatic latent image is developed by developing means 104 as a toner image. On the other hand, a recording material P fed from a sheet feed cassette 108 is conveyed by conveying rollers 182 etc. to a transferring portion T1, at which the toner image on the photosensitive member 101 is transferred onto the transferring material P by a transferring roller 159 to which a predetermined transferring bias is applied by a power source 154. Transfer residual toner remaining on the photosensitive member is cleaned by cleaning means 106. The toner image having been transferred on the transferring material P is fixed by fixing means 107. Image control in this structure is performed in such a way that a test pattern formed on the photosensitive member 101 by analogue development is transferred onto the transferring material P so as to be detected by test pattern detection means 190, so that control means 210 performs the image control based on a result of the detection.

Figure 14:
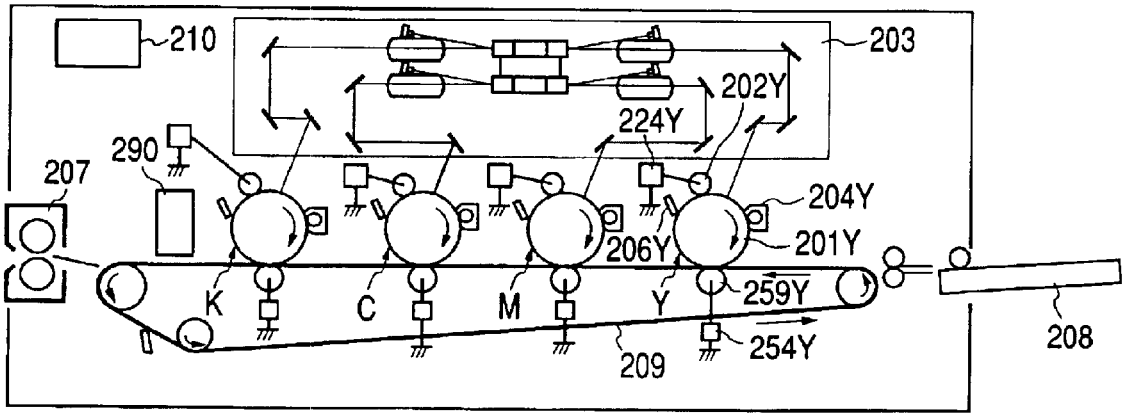
FIG. 14 is a view showing another alternative image forming apparatus according to embodiment 1.

FIG. 14 shows an example of an apparatus that transfers a toner image on a photosensitive member onto a transferring material conveyed by a transferring material conveying belt serving as a transferring material carrying member, which is constructed in such a way that a test pattern is transferred onto the transferring material conveying belt directly. This structure is provided with four image forming portions Y, M, C and K that are capable of forming toner images of different colors arranged along the conveying direction of the transferring material conveying belt, which sequentially form images on a transferring material carried or conveyed by the transferring material conveying belt to form a color image. Since these image forming portions have the same structure, the following description will be made with respect to the image forming portion Y for forming yellow images and the descriptions of the other image forming portions will be omitted. In FIG. 14, charging is performed on a photosensitive member 201Y by a charging roller 202Y to which a predetermined bias is applied by a power source 224Y. Exposure of the surface of the photosensitive member 201Y thus charged is performed by the exposure means 203, so that an electrostatic latent image is formed. The electrostatic latent image is developed by developing means 204Y as a toner image. On the other hand, a recording material fed from a sheet feed cassette 208 is conveyed to a transferring portion while carried by a transferring material conveying belt 209, at which transferring portion the toner image on the photosensitive member 201Y is transferred onto the transferring material by a transferring roller 259Y to which a predetermined transferring bias is applied by a power source 254Y. Transfer residual toner remaining on the photosensitive member is cleaned by cleaning means 206Y. The toner image having been transferred on the transferring material is fixed by fixing means 207. Image control in this structure is performed in such a way that test patterns formed on the respective photosensitive members by analogue development are transferred onto the transferring material conveying belt 209 directly so as to be detected by test pattern detection means 290, so that control means 210 performs the image control based on a result of the detection.

In those apparatus shown in FIGS. 13 and 14 also, upon transferring a test pattern formed by analogue development from an image bearing member to a transferring material or the transferring material carrying member, optimal transferring of the test pattern can be realized by setting the transferring bias for transferring the test pattern based on the surface potential of the image bearing member on which the test patter is formed, the charging bias or the developing bias in the manner described before.

Embodiment 2

In the control process according to the above-described embodiment 1, the value of the charge potential Vd' upon forming a test pattern by analogue development is set to a value equal to the charge potential Vd upon forming a normal image.

In contrast, in this embodiment 2, the value of the charge potential Vd' upon forming a test pattern by analogue development is set to a value different from the charge potential Vd upon forming a normal image.

The structure of the image forming apparatus according to this embodiment is the same as that of the above-described embodiment 1, and therefore the description thereof will be omitted and a description will be made here mainly of a method of forming a test pattern by analogue development.

Figure 5:
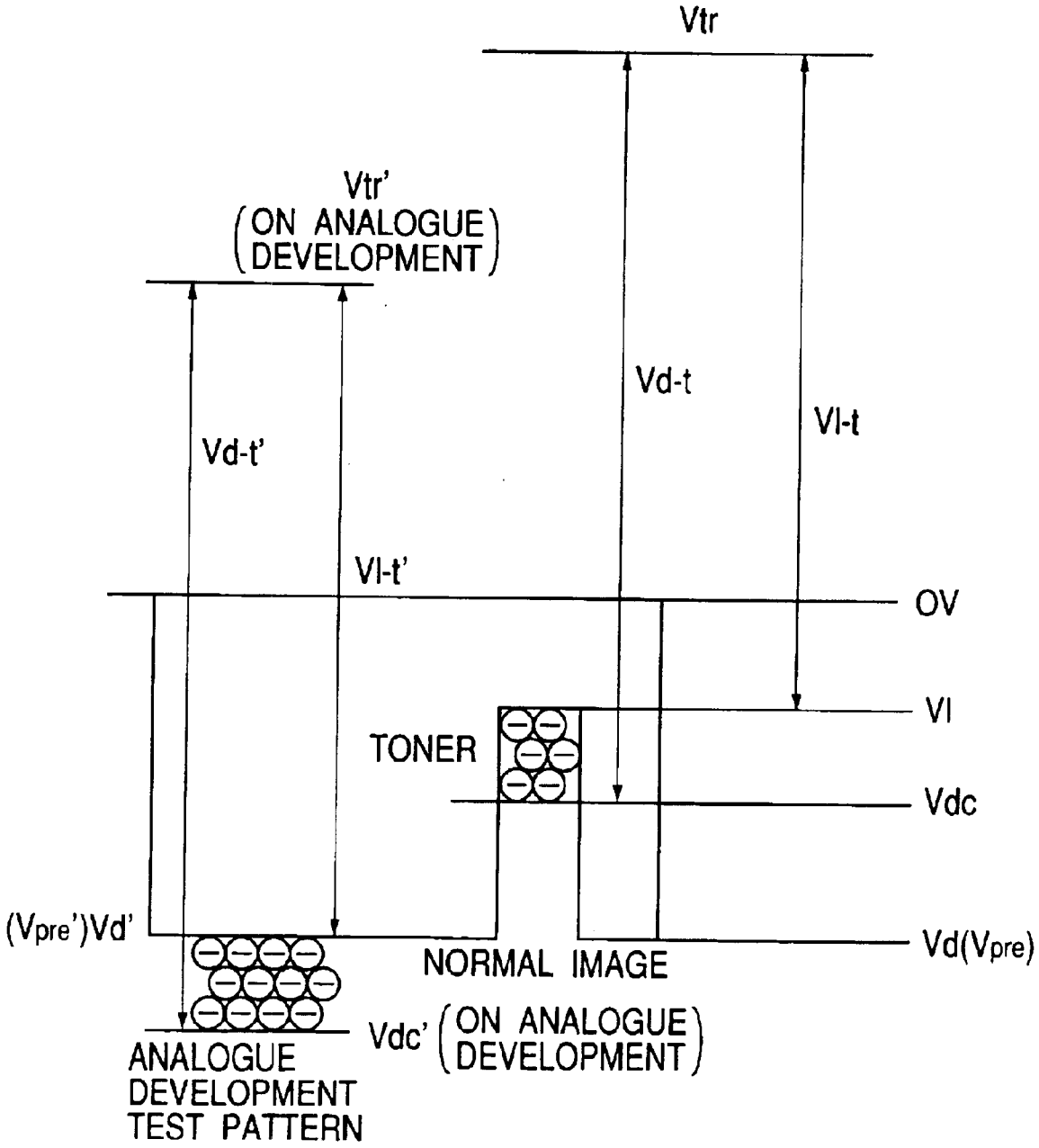
FIG. 5 is a diagram showing a relationship of charge potentials (including a dark portion potential and bright portion potential) of a photosensitive drum, a developing bias and a transferring bias in the image forming apparatus according to the embodiment 1.

In the above-described embodiment 1, the charge voltage Vd (dark portion voltage) upon normal image formation is the same as the charge voltage Vd' upon analogue development as shown in FIG. 5. However, such a control sometimes causes problems as follows.

Since the developing bias upon analog development is required to be a value of negative polarity larger than that upon normal image formation, a high voltage power source for the developing bias is required to have a larger capacity.

Furthermore, as shown in FIG. 6, when the value of Vd is large while having negative polarity, since the developing bias upon analogue development is required to have a larger value with negative polarity, upon setting a transferring bias Vtr' corresponding to a developing bias Vdc' while maintaining the potential difference Vd-t between the developing bias and the transferring bias upon normal image formation, a situation in which Vtr' is required to have negative polarity can occur. In that case, the high voltage power source for the transferring bias is required to have both positive and negative polarities. This will lead to an increase in the cost.

In view of the above, upon forming a test pattern by analogue development, it is preferable to use a charging bias different from the charging bias upon normal image formation. In addition, it is preferable that the charging bias upon analogue development be a value smaller than that upon normal image formation while having negative polarity and the value be fixed irrespective of environmental or other conditions.

Figure 7:
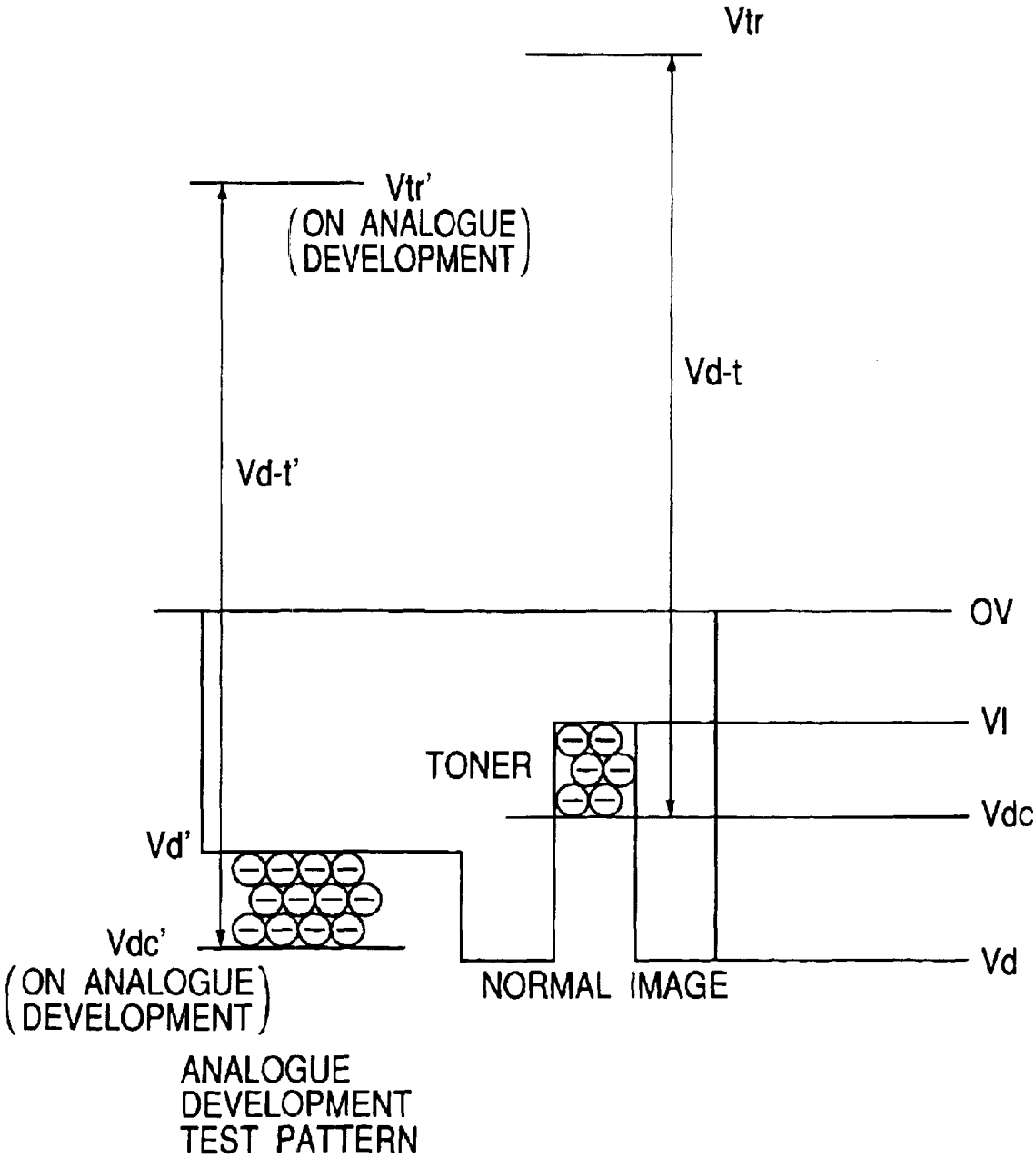
FIG. 7 is a diagram showing a relationship of charge potentials (including a dark portion potential and bright portion potential) of a photosensitive drum, a developing bias and a transferring bias in the image forming apparatus according to embodiment 2.

FIG. 7 is a diagram showing a relationship of biases upon forming a test pattern by analogue development in this embodiment. In the right portion of FIG. 7, the dark portion potential Vd of the photosensitive drum 1, the bright portion potential Vl of the photosensitive drum 1 and the DC component Vdc of the developing bias applied to the developing apparatus upon forming a normal image and the transferring bias Vtr upon transferring a normal image are shown. On the other hand, in the left portion of FIG. 7, the dark portion potential Vd' of the photosensitive drum 1 upon forming a test pattern by analogue development is shown, wherein the dark potion potential Vd' has an absolute value smaller than that of the above-mentioned potential Vd while having negative polarity, and accordingly the developing bias Vdc' applied to the developing apparatus 4 has an absolute value smaller than the above-mentioned bias Vdc while having negative polarity. While in the normal image forming process the charging bias is changed depending on variations in conditions such as environmental temperature or humidity, the charging bias upon analogue development is not changed, in this embodiment, irrespective of environmental or other conditions. With this feature, calculation of stable developing contrast can be made possible, and a density control with an improved precision can be realized.

Embodiment 3

Embodiment 3 is to perform an ATVC for setting the transferring bias upon transferring a test pattern formed by analogue development independently of an ATVC for setting the transferring bias upon transferring a normal image.

As described above, so long as the potential difference between the surface potential of the photosensitive member and the transferring bias is the same, the transferring current remains substantially the same if the absolute value of the surface potential of the photosensitive body and the absolute value of the transferring bias vary, and therefore it is not necessary to set the transferring bias for analogue development additionally.

However, the image density of test patterns formed by analogue development often differs from that of normal images. As to normal images, it is assumed that a plurality of colors are transferred in a overlapping manner, and the transferring setting needs to be determined taking this into consideration. On the other hand, a test pattern is generally formed with a single color. In addition, in the case that a halftone test pattern is to be formed, sufficient transferring can be realized with a relatively low transferring bias. Therefore, it is important, in order to realizing optimal transferring of a test pattern, to set a transferring bias for realizing a transferring current that is more optimum for test pattern transfer independently from transferring of normal images.

In view of the above, in this embodiment, an ATVC is performed independently of the normal ATVC in order to set an optimum transferring bias upon transferring a test pattern formed by analogue development. The detail of this process will be described in the following.

In the ATVC for setting a transferring bias upon normal image formation, the transferring bias is determined in such a way that a predetermined transferring current Itr would pass in the state in which the surface of the photosensitive drum is charged up to Vd and the charged area is in the vicinity of the transferring portion. The detail of this method has been described before in the description of the embodiment 1 with reference to FIG. 4.

Figure 8:
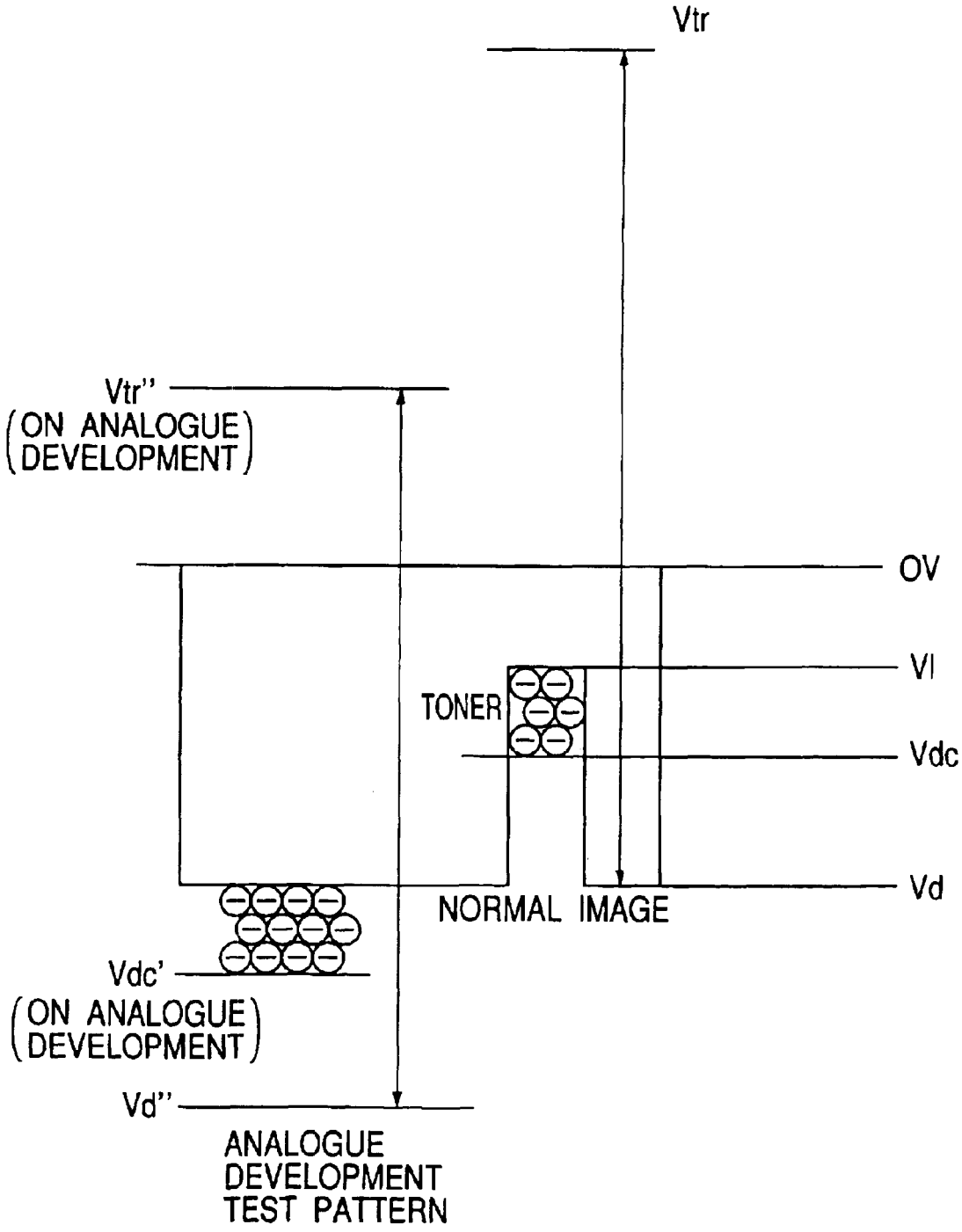
FIG. 8 is a diagram showing a relationship of charge potentials (including a dark portion potential and bright portion potential) of a photosensitive drum, a developing bias and a transferring bias in the image forming apparatus according to embodiment 3.
Figure 9:
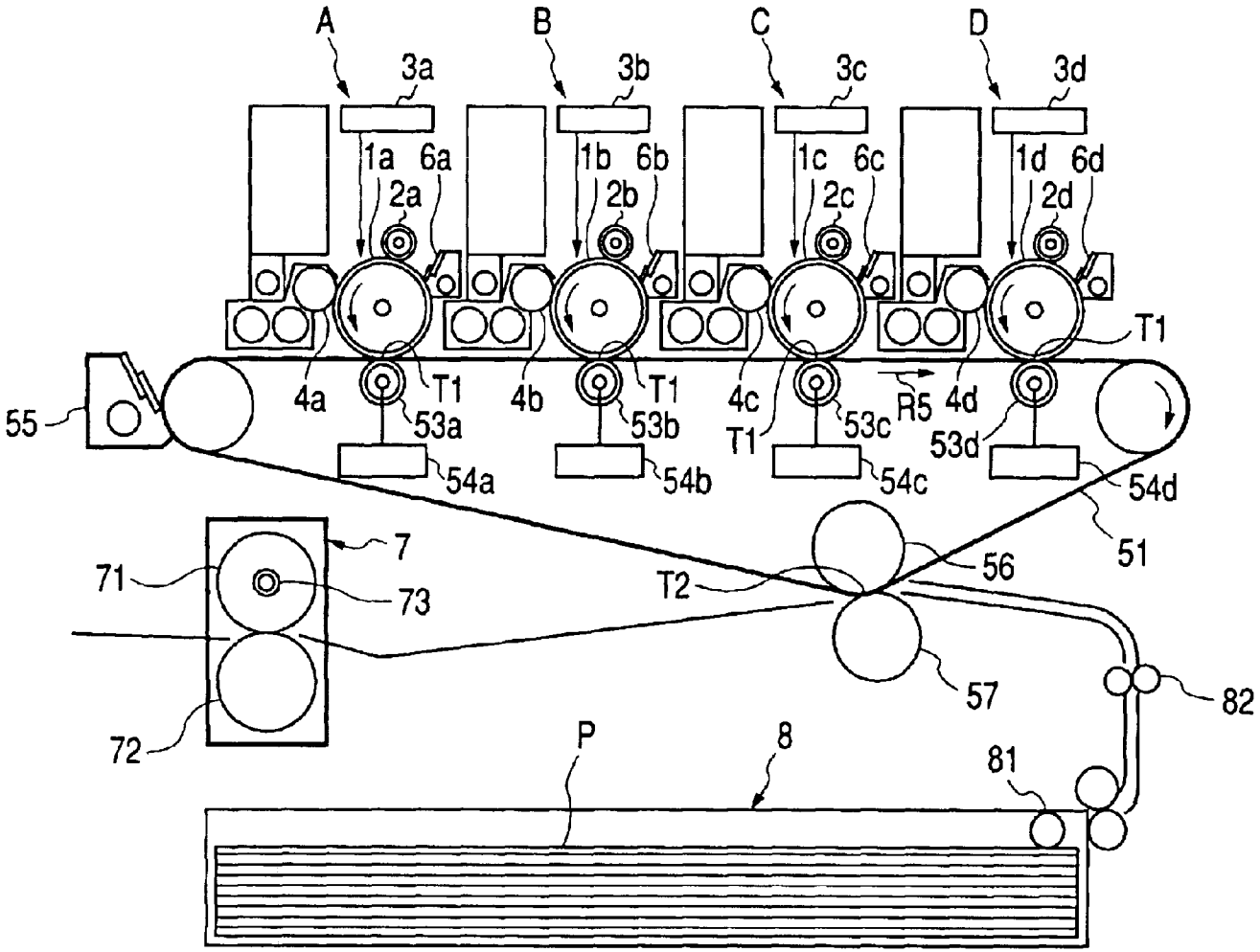
FIG. 9 is a longitudinal sectional view schematically showing the structure of a conventional image forming apparatus.
Figure 10:
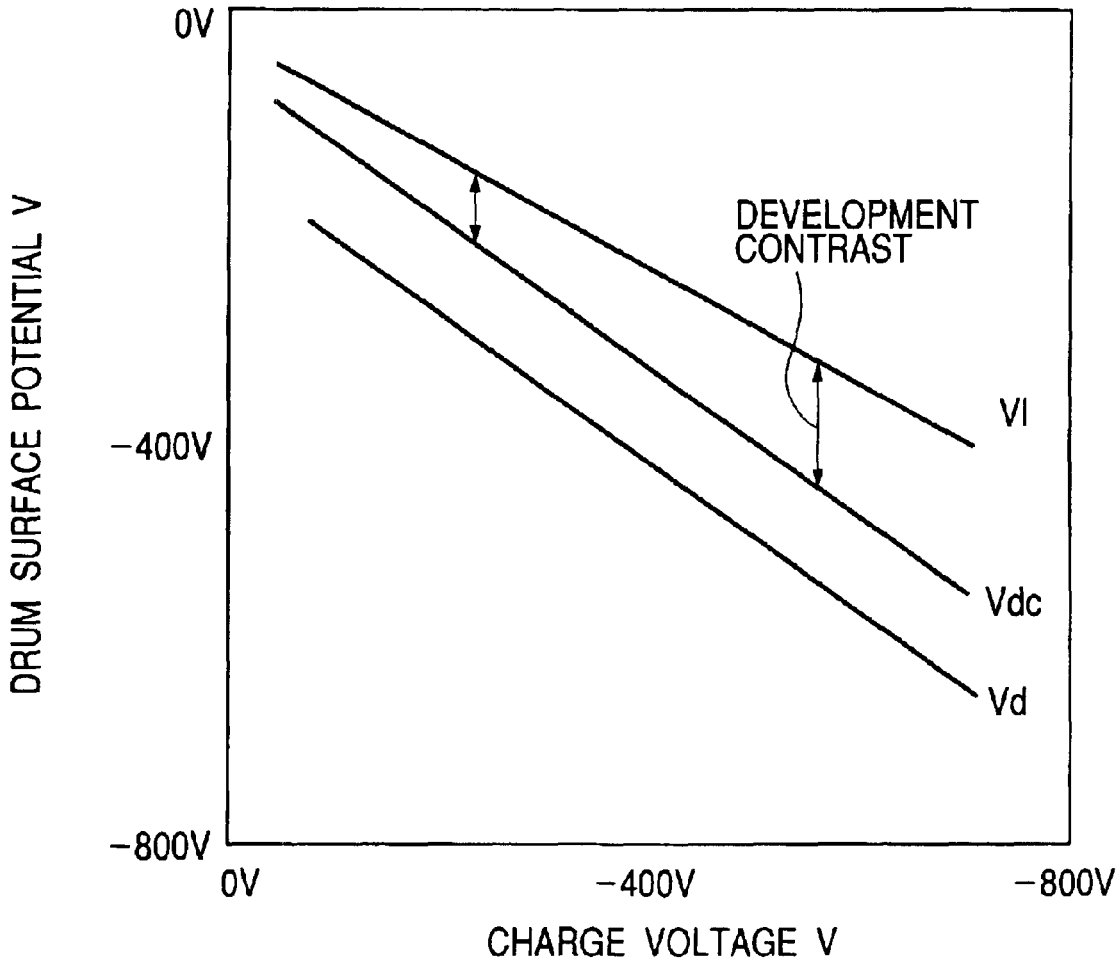
FIG. 10 is a graph showing a relationship of charge potentials (including a dark portion potential and bright portion potential) of a photosensitive drum and a developing bias in the conventional image forming apparatus.

In the method for setting an optimum transferring bias upon transferring a test pattern formed by analogue development, the transferring bias is determined, as shown in FIG. 8, in such a way that a predetermined transferring current Itr' would pass in the state in which the surface of the photosensitive drum 1 is charged up to Vd" and the charged area is in the vicinity of the transferring portion (i.e. opposed to the transferring portion). Here, Vd" is the value obtained by adding the potential difference between the charge potential Vd and the developing bias Vdc upon normal image formation to the DC component Vdc' of the developing bias applied upon analogue development, that is:

$$Vd''=Vdc'+(Vd-Vdc)$$

Here, Vd, Vdc' and Vd" upon analogue development may be considered parallel to the relationship of Vl, Vds and Vd upon normal image formation. Thus, the transferring bias Vtr" for realizing the optimum transferring current Itr' can be determined by performing the ATVC in the manner same as described before under the state in which the surface of the photosensitive drum is charged up to Vd".

By transferring a test pattern formed by analogue development with the transferring bias determined by the above method and detecting the reflection density, it is possible to perform a density control with an improved precision.

While this embodiment has been described based on a case in which the value of Vd is the same upon analogue development and upon normal image formation, different values Vd and Vd' may be set as described in the above-described embodiment 2.

While embodiment 1 has been described based on a structure in which the intermediate transfer belt 51 is used as an intermediate transfer member, an intermediate transfer drum having a drum shape may be used instead.

While the embodiments 1 to 3 have been described based on cases in which the photosensitive drum has a charge property of negative polarity, the present invention is not limited to this feature. The present invention can also be applied to the case in which the photosensitive drum has a charge property of positive polarity (for example, in the case that the photosensitive drum is composed of an amorphous silicone photosensitive member). In that case, the polarities appearing in the foregoing description should be reversed.

What is claimed is:

1. An image forming apparatus comprising:

charging means for charging an image bearing member;

exposure means for exposing the image bearing member, which has been charged to form an electrostatic latent image;

developing means for developing the electrostatic latent image with developer;

transferring means, to which a transferring bias under constant voltage control is applied, for transferring a developer image on the image bearing member onto an other member;

test pattern forming means for forming a test pattern for image control on the image bearing member by supplying developer by said developing means on an area of the image bearing member in which charging by said charging means is effected and exposure by said exposure means is not effected;

test pattern detection means for detecting the test pattern, which has been transferred to the other member by said transferring means; and control means for setting a value of the transferring bias upon transferring of the test pattern onto the other member in accordance with a surface potential of the image bearing member upon formation of the test pattern.

2. An image forming apparatus according to claim 1, wherein said control means sets a value of Vtr in such a way that a potential difference between Vl and Vtr is substantially equal to a potential difference between Vd and Vtr where:

Vl represents a surface potential of the image bearing member, which has been exposed by said exposure means upon formation of a normal image;

Vtr represents a value of the transferring bias applied to said transferring means upon transferring of the normal image;

Vd represents a surface potential of the image bearing member, which has been charged by said charging means upon formation of the test pattern; and Vtr represents a value of the transferring bias applied to said transferring means upon transferring of the test pattern.

3. An image forming apparatus according to claim 1, wherein a developing bias for supplying the developer is applied to said developing means, and wherein a value of the developing bias upon formation of a normal image is different from a value of the developing bias upon formation of the test pattern.

4. An image forming apparatus according to claim 1, wherein a value of a surface potential of the image bearing member, which has been charged by said charging means upon formation of a normal image is different from a value of a surface potential of the image bearing member, which has been charged by said charging means upon formation of the test pattern.

5. An image forming apparatus comprising:

charging means, to which a charging bias is applied, for charging an image bearing member;

exposure means for exposing the image bearing member, which has been charged to form an electrostatic latent image;

developing means for developing the electrostatic latent image with developer;

transferring means, to which a transferring bias under constant voltage control is applied, for transferring a developer image on the image bearing member onto an other member;

test pattern forming means for forming a test pattern for image control on the image bearing member by supplying developer by said developing means to an area on the image bearing member in which charging by said charging means is effected and exposure by said exposure means is not effected;

test pattern detection means for detecting the test pattern, which has been transferred to the other member by said transferring means; and control means for setting a value of the transferring bias upon transferring of the test pattern onto the other member in accordance with a value of the charging bias applied to said charging means upon formation of the test pattern.

6. An image forming apparatus according to claim 5, wherein said control means sets a value of Vtr in such a way that a potential difference between Vl and Vtr is substantially equal to a potential difference between Vpre and Vtr where:

Vl represents a surface potential of the image bearing member, which has been exposed by said exposure means upon formation of a normal image;

Vtr represents a value of the transferring bias applied to said transferring means upon transferring of the normal image;

Vpre represents the charging bias applied to said charging means upon formation of the test pattern; and Vtr represents a value of the transferring bias applied to said transferring member upon transferring of the test pattern.

7. An image forming apparatus according to claim 5, wherein a developing bias for supplying the developer is applied to said developing means, and wherein a value of the developing bias upon formation of a normal image is different from a value of the developing bias upon formation of the test pattern.

8. An image forming apparatus according to claim 5, wherein a value of the charging bias applied to said charging means upon formation of a normal image is different from a value of the charging bias applied to said charging means upon formation of the test pattern.

9. An image forming apparatus comprising:

charging means for charging an image bearing member;

exposure means for exposing the image bearing member, which has been charged to form an electrostatic latent image;

developing means, to which a developing bias is applied, for supplying the image bearing member with developer;

transferring means, to which a transferring bias under constant voltage control is applied, for transferring a developer image on the image bearing member onto an other member;

test pattern forming means for forming a test pattern for image control on the image bearing member by supplying developer by said developing means to an area on the image bearing member in which charging by said charging means is effected and exposure by said exposure means is not effected;

test pattern detection means for detecting the test pattern, which has been transferred to the other member by said transferring means; and control means for setting a value of the transferring bias upon transferring of the test pattern onto the other member in accordance with a value of the developing bias upon formation of the test pattern.

10. An image forming apparatus according to claim 9, wherein said control means sets a value of Vtr in such a way that a potential difference between Vdc and Vtr is substantially equal to a potential difference between Vdc and Vtr where:

Vdc represents a value of the developing bias applied to the developing means upon formation of a normal image;

Vtr represents a value of the transferring bias applied to said transferring means upon transferring of the normal image;

Vdc represents a value of the developing bias applied to said developing means upon formation of the test pattern; and Vtr represents a value of the transferring bias applied to said transferring member upon transferring of the test pattern.

11. An image forming apparatus according to claim 9, wherein a value of a surface potential of the image bearing member, which has been charged by said charging means upon formation of a normal image is different from a value of a surface potential of the image bearing member, which has been charged by said charging means upon formation of the test pattern.

* * * * *

UNITED STATES PATENT AND TRADEMARK OFFICE

CERTIFICATE OF CORRECTION

PATENT NO. : 6,904,245 B2
DATED : June 7, 2005
INVENTOR(S) : Jun Mochizuki et al.

It is certified that error appears in the above-identified patent and that said Letters Patent is hereby corrected as shown below:

Title page,
Item [56], References Cited, FOREIGN PATENT DOCUMENTS,
"JP 10048968 A 2/1998" should read -- JP 10-48968 A 2/1998 --.
Item [57], ABSTRACT,
Line 8, "other" should read -- another --.

Column 2,
Line 33, "not be" should read -- not to be --;
Line 42, "control," should read -- controls, --;
Line 52, "performed" should read -- practiced --; and
Line 54, "normal" should read -- a normal --.

Column 3,
Line 9, "contrast is," should read -- contrast, --; and
Line 10, "amount" should read -- the amount --; and "is developed" should read -- developed --.

Column 4,
Lines 43 and 61, "other" should read -- the other --.

Column 5,
Line 18, "other" should read -- the other --.

Column 7,
Lines 26 and 27, "direction or" should read -- direction of --.

Column 9,
Line 20, "portions" should read -- portion --; and
Line 65, "images" should read -- image --.

Column 10,
Line 39, "on one" should read -- on a one --.

Column 11,
Line 19, "because" should read -- done --; and
Line 59, "case that" should read -- case wherein --.

Column 13,
Line 12, "between at" should read -- between --; and
Line 13, "and at" should read -- and --.

UNITED STATES PATENT AND TRADEMARK OFFICE

CERTIFICATE OF CORRECTION

PATENT NO. : 6,904,245 B2
DATED : June 7, 2005
INVENTOR(S) : Jun Mochizuki et al.

It is certified that error appears in the above-identified patent and that said Letters Patent is hereby corrected as shown below:

Column 14,
Line 10, “etc is” should read -- etc. is --.

Column 15,
Line 18, “test patter” should read -- test pattern --.

Column 16,
Line 7, “potion” should read -- portion --;
Line 21, “is to perform” should read -- is intended to perform --;
Line 31, “bias” should read -- bias additionally --;
Line 32, “ment additionally.” should read -- ment. --;
Line 39, “case that” should read -- case wherein --; and
Line 42, “realizing” should read -- realize --.

Column 17,
Line 33, “that” should read -- wherein --.

Signed and Sealed this

Twenty-second Day of November, 2005

JON W. DUDAS
*Director of the United States Patent and Trademark Office*